United States Patent [19]

Lloyd et al.

[11] 4,109,036

[45] Aug. 22, 1978

[54] ARTIFICIAL CHRISTMAS TREE

[76] Inventors: Gary Richard Lloyd; Rita Rae Lloyd, both of 11438 Elm, Taylor, Mich. 48180

[21] Appl. No.: 787,896

[22] Filed: Apr. 15, 1977

[51] Int. Cl.[2] ..... A47G 33/06

[52] U.S. Cl. ..... 428/8; 248/536; 428/20

[58] Field of Search ..... 248/519, 48.2, 536; 428/7, 18, 19, 20, 8; 156/61, 71

[56] References Cited

U.S. PATENT DOCUMENTS

| | | | |
|---|---|---|---|
| 2,864,192 | 12/1958 | Shoalts | 428/18 X |
| 3,027,671 | 4/1962 | Duvall | 428/18 X |
| 3,381,635 | 5/1968 | Pforr | 248/519 X |
| 3,857,748 | 12/1974 | Thomann | 428/20 X |
| 3,985,924 | 10/1976 | Pritza | 428/20 X |

FOREIGN PATENT DOCUMENTS

| | | | |
|---|---|---|---|
| 931,480 | 7/1963 | United Kingdom | 428/20 |

*Primary Examiner*—George F. Lesmes
*Assistant Examiner*—Henry F. Epstein
*Attorney, Agent, or Firm*—Charles W. Chandler

[57] ABSTRACT

An artificial Christmas tree having an upright trunk supporting a plurality of branches to simulate foliage extending about the longitudinal axis of the trunk through an arc less than 360° but greater than 90° that permits the trunk to be supported closely adjacent a wall so that the tree occupies less floor space than a natural tree of the same height.

1 Claim, 6 Drawing Figures

ARTIFICIAL CHRISTMAS TREE

BACKGROUND OF THE INVENTION

This invention relates to artificial Christmas trees, and more particularly to such a tree having a trunk supporting branches such that the tree can be disposed with the trunk closely adjacent a wall.

Artificial Christmas trees are very popular because of their symmetry, color, lack of falling needles, and reuseability. However, such trees, like natural trees, occupy a relatively large floor space if the tree is of a substantial height. Consequently, if the user has limited floor space to accomodate a conventional tree, the height of the tree is limited by the floor restriction.

SUMMARY OF THE INVENTION

The broad purpose of the present invention is to provide an artificial tree having a substantial height but occupying less floor space than conventional trees of comparable height, by providing a tree in which the trunk is supported closely adjacent a wall. In the preferred embodiment, which will be described in greater detail, the branches are supported by the trunk through an arc of only about 180° about the trunk. Another embodiment of the invention is adapted to be mounted adjacent an exposed corner formed by two intersecting walls, so that branches are supported through an arc of about 270° about the trunk. Still another embodiment is adapted to be mounted in an internal corner so that the branches are supported through an arc of only 90° about the longitudinal axis of the trunk.

Still further objects and advantages of the invention will become apparent to those skilled in the art of the invention upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENTS

Figure 1:
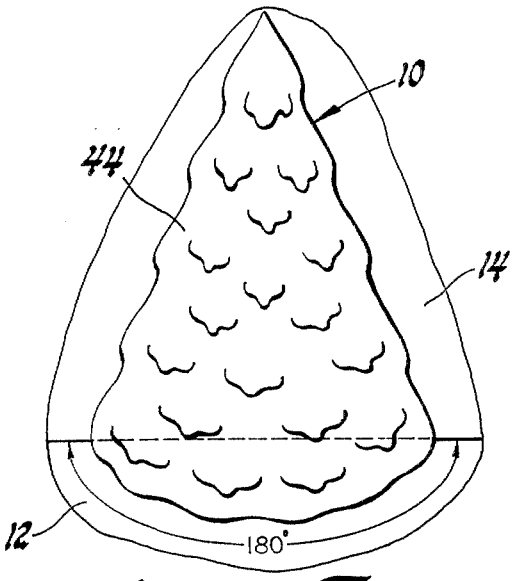
FIG. 1 illustrates an artificial Christmas tree illustrating the preferred embodiment of the invention.

Now referring to the drawing, FIG. 1 illustrates a preferred artificial Christmas tree 10 mounted on floor 12 adjacent wall 14. Tree 10 includes supporting base means 16 formed of a flat semi-circular plate 18 disposed on floor 12. An upright plate 20 has its lower edge connected to plate 18. A tubular member 22 is supported in a vertical position with its lower end attached to plate 18 and its side edge attached to plate 20 such that its upper open end forms a socket 24.

A gusset 26 is attached to plate 18 and to tubular member 24 to reinforce the upright position of the tubular member.

A pair of threaded fasteners 28 and 30, received through appropriate openings in plate 20, fasten base means 16 to wall 14 to prevent movement of the base means with respect to the wall.

Figure 4:
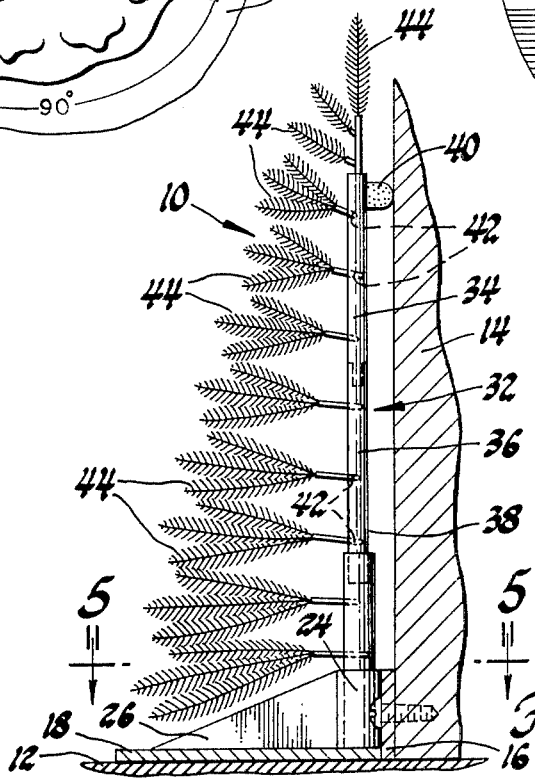
FIG. 4 is a longitudinal sectional view through the tree of FIG. 1.

Referring to FIG. 4, trunk means, generally illustrated at 32, comprises three elongated trunk members 34, 36, and 38. The upper end of trunk member 38 has an opening for receiving the lower end of trunk member 36, while the upper end of member 36 has an opening for receiving trunk member 34 so that the three trunk members are interconnected to form trunk means 32. The lower end of trunk means 32 is received in socket 24 so as to be supported in a vertical upright position adjacent wall 14. Trunk member 32 is slightly spaced from the wall by a rubber bumper 40 attached to the upper end of the trunk member.

The three trunk members 34, 36, and 38 each have a plurality of openings 42 for receiving a plurality of branches 44, each branch being received in one of the openings 42. The branches are progressively longer in length from the top to the bottom of the trunk means to collectively simulate foliage. The branches 44 are disposed in an angle of about 180° about the longitudinal axis of trunk means 32 as is illustrated in FIG. 1. This arrangement permits a substantially higher tree to be mounted on floor 12 adjacent wall 14 because half of the floor space necessary for a full size tree has been eliminated.

Branches 44 are each individually removable from their respective opening 42 so that by disassembling the trunk means and the individual branches, the preferred tree can be stored in a compact location between Christmas seasons.

Figure 2:
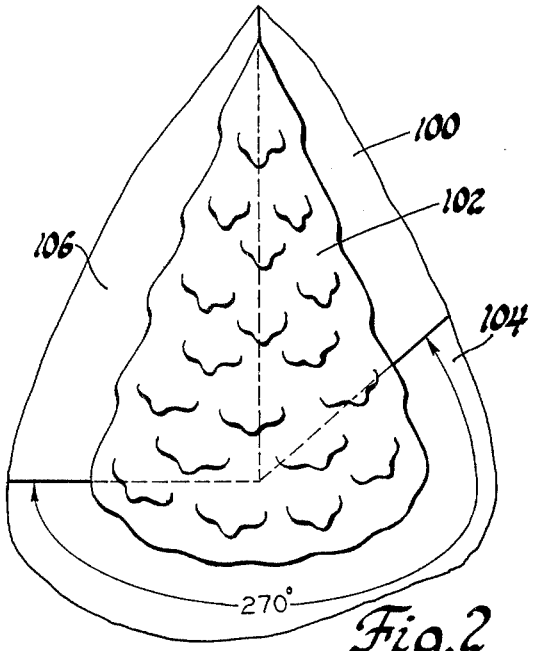
FIG. 2 illustrates another embodiment of the invention.

A similar tree is illustrated in FIG. 2 in which the base (not shown) is mounted adjacent a wall 100 to support tree 102 on floor 104. A second wall 106 intersects wall 100 to form an exposed corner. In this case, the branches of the tree are supported in an arc of about 270° about the longitudinal axis of the trunk so it can be mounted closely adjacent the corner formed by the two intersecting walls.

Figure 3:
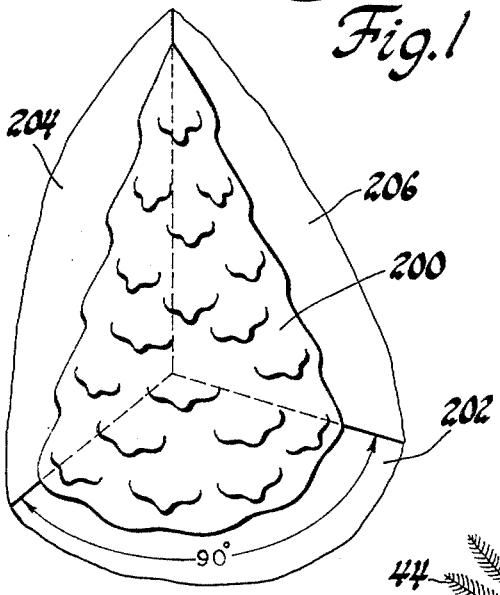
FIG. 3 illustrates still another embodiment of the invention.
Figure 5:
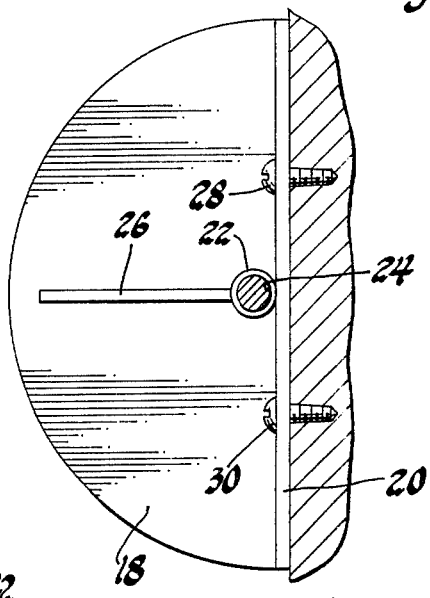
FIG. 5 is a view taken along lines 5—5 of FIG. 4.

FIG. 3 shows another embodiment of the invention in which a tree 200 is mounted on floor 202 in a closed corner formed by a pair of intersecting walls 204 and 206.

Figure 6:
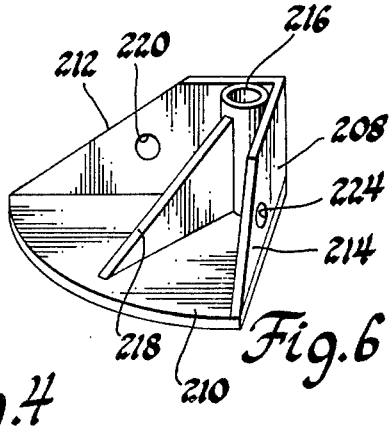
FIG. 6 is a perspective view of the base for the embodiment of FIG. 3.

FIG. 6 shows a base means 208 employed for supporting tree 200. Base means 208 includes a base plate 210 mounted on floor 202. A pair of side plates 212 and 214 are mounted at right angles to one another in an upright position along the side edges of plate 210. A tube 216 is disposed in the corner formed by side plates 212 and 214 to support the trunk (not shown) of the tree, and is reinforced in its upright position by a gusset 218. Openings 220 and 224 in side plates 212 and 214, respectively, are suited for receiving fasteners for attaching the base means to the walls 204 and 206.

In each embodiment of the invention, the upper end of the tree is not attached to the wall, and the weight of the tree is supported on the floor. The base is attached to the wall adjacent the floor by a pair of fastening members, which may not be necessary depending upon the weight of the tree and its tendency to lean away from the wall. The preferred tree can be readily assembled to form a simulated Christmas tree having apparent fullness but occupying less space than a natural tree of comparable height.

Having described our invention, we claim:

1. In combination with a horizontal floor and a vertical wall, an artificial Christmas tree comprising:

a horizontal base plate disposed on the floor;

a tubular member supported in a vertical position with its lower edge attached to the base plate such that the upper end of the tubular member forms a socket;

fastener means for connecting the tubular member to the vertical wall adjacent the floor such that the fastener means cooperate with the base plate in preventing movement of the tubular member away from the wall;

an elongated trunk having a lower end and an upper end, the lower end being removably received in the socket such that the trunk is disposed in a substantially vertical position adjacent the wall, said trunk having a plurality of longitudinally spaced branch-receiving openings;

a plurality of branches, each being received in a branch-receiving opening so as to be supported about the longitudinal axis of the trunk in an arc less than 360° but greater than 90° such that the branches collectively cooperate in simulating the foilage of a Christmas tree;

the upper end of the trunk being horizontally movable with respect to the wall; and a bumper connected to the trunk adjacent the upper end thereof between the trunk and the wall such that the upper end of the trunk is spaced from the wall.

* * * * *